US005820275A

United States Patent [19]

Crawford et al.

[11] Patent Number: 5,820,275

[45] Date of Patent: Oct. 13, 1998

[54] PRINTER MULTI-FUNCTION DRIVE TRAIN APPARATUS AND METHOD

[75] Inventors: Timothy L. Crawford, Tigard; James D. Rise; Barry D. Reeves, both of Lake Oswego; Nathan E. Hult; William Y. Pong, both of Tualatin; Richard G. Chambers; Michael E. Jones, both of Portland, all of Oreg.

[73] Assignee: Tektronix, Inc., Wilsonville, Oreg.

[21] Appl. No.: 375,332

[22] Filed: Jan. 17, 1995

[51] Int. Cl.[6] ..... B41J 23/34

[52] U.S. Cl. ..... 400/185; 347/103; 400/187; 400/568; 400/624

[58] Field of Search ..... 347/103, 8, 101, 347/104; 400/185, 187, 568, 569, 624, 629, 55, 56, 57, 58, 59; 101/232, 234, 408, 409, 423, 425

[56] References Cited

U.S. PATENT DOCUMENTS

| | | | |
|---|---|---|---|
| 3,463,082 | 8/1969 | Kaufer | 101/232 |
| 4,538,156 | 8/1985 | Durkee et al. | 346/21 |
| 4,800,813 | 1/1989 | Leyendecker et al. | 101/409 |
| 4,929,105 | 5/1990 | Hirayama et al. | 400/569 |
| 4,949,638 | 8/1990 | Watanabe | 400/185 |
| 4,971,467 | 11/1990 | Kamei et al. | 400/185 |
| 5,206,737 | 4/1993 | Sugiyama | 400/187 |
| 5,226,743 | 7/1993 | Jackson et al. | 400/185 |
| 5,419,543 | 5/1995 | Nakamura et al. | 400/624 |
| 5,531,527 | 7/1996 | Maekawa et al. | 400/187 |
| 5,564,842 | 10/1996 | Kida et al. | 400/629 |
| 5,608,430 | 3/1997 | Jones et al. | 347/8 |

FOREIGN PATENT DOCUMENTS

| | | | |
|---|---|---|---|
| 59-076280 | 5/1984 | Japan | 400/185 |
| 62-007575 | 1/1987 | Japan | 400/624 |
| 62-227678 | 10/1987 | Japan | 400/185 |
| 2-113965 | 4/1990 | Japan | 400/569 |
| 6-106717 | 4/1994 | Japan | 347/103 |
| 6-122194 | 5/1994 | Japan | 347/103 |
| 6-126946 | 5/1994 | Japan | 347/103 |

*Primary Examiner*—David A. Wiecking
*Attorney, Agent, or Firm*—Ralph D'Alessandro; Richard B. Preiss

[57] ABSTRACT

A process motor (82) provides bidirectional motive force to a printer (50) drive train (80) that selectively engages with multiple self-homing printing functions. A print head (52) is tiltable to a maintenance position and a transfer roller (64) is loadable against a transfer drum (54) by respective missing tooth gear (96, 160) latching mechanisms. A print media pick roller (122) and transfer drum maintaining devices (70, 72) are actuated by spring-wrap clutches (114, 236) that are protected from reverse rotation by a one-way clutch (106). Print media transport rollers (140, 142) are selectively engaged with the one-way clutch by an electro-mechanical clutch (128). A picked and transported print medium (56) receives an ink image from the transfer drum and is stripped therefrom by stripper fingers (66) and directed into media exit rollers (212, 220) for delivery to a media output tray (68). The stripper fingers and exit rollers are actuated sequentially by cams (180, 182) that are slaved to the transfer roller loading function.

24 Claims, 6 Drawing Sheets

PRINTER MULTI-FUNCTION DRIVE TRAIN APPARATUS AND METHOD

TECHNICAL FIELD

This invention relates to ink-jet printers and more particularly to a single motor driven printing process drive train that selectively engages print head tilt, media picking, media transport, transfer roller loading, media stripper finger engagement, exit gear train engagement, and drum maintenance functions.

BACKGROUND OF THE INVENTION

There are known apparatus and methods for using a single motive force to selectively energize multiple functions. For example, an automobile engine not only propels the automobile through a multi-ratio reversible transmission, but also typically includes power takeoffs for an oil pump, a valve timing cam shaft, an ignition distributor, an alternator, a power steering pump, and an air conditioning compressor.

The cam shaft and ignition distributor are permanently coupled and precisely indexed to a rotational angle of the engine to provide proper valve and ignition timing operation, whereas the oil pump, alternator, and power steering pump are also permanently coupled to the engine, but require no angular indexing for proper operation. In contrast, the air conditioning compressor is selectively engaged when needed by an electric clutch and also requires no angular indexing for proper operation. Of course, the engine rotates in a single direction, and indeed, reverse rotation could cause severe engine damage.

Printers, copiers, and facsimile machines are other examples of mechanically complex devices that perform multiple print producing functions. FIG. 1 shows an exemplary transfer printer 10, which is described in U.S. Pat. No. 4,538,156 issued Aug. 27, 1985 for an INK JET PRINTER. A multiple-orifice ink-jet print head 12 deposits an ink image on a surface 14 of a transfer drum 16 that is rotated by a motor (not shown) driving a drum shaft 18. A print medium 20 received from a media supply tray 22 is advanced into a nip formed between transfer drum 16 and a transfer roller 24. A solenoid 26 is energized actuating a linkage 28 that pivots an arm 30 holding transfer roller 24 such that print medium 20 is pressed in the nip between transfer drum 16 and transfer roller 24. The rotation of drum 16 draws print medium 20 through the nip, thereby transferring the ink image from drum surface 14 to print medium 20 while feeding it into an exit path 32. After print medium 20 leaves the nip, solenoid 26 is de-energized and a solenoid 34 is energized, pivoting an arm 36 holding a web roller 38 such that a drum cleaning web 40 is drawn into contact with and cleans surface 14 of transfer drum 16. The rotation of transfer drum 16 draws cleaning web 40 from a web supply spool 42 to a web take-up spool 44. After transfer drum 16 is adequately cleaned, solenoid 34 is de-energized and the above-described process may be repeated.

In practice, such printers may also include print processing functions not shown in FIG. 1, such as a print media picking function that picks a single sheet of print medium 20 from media supply tray 22, a print media transport function that transfers print medium 20 into the nip, a stripper finger engagement function that strips print medium 20 off transfer drum 16, an exit path engagement function that drives print medium 20 into exit path 32, a web take-up spool 44 driving function that provides a fresh supply of drum cleaning web 40, and a print head positioning function that provides adequate clearance between transfer drum 16 and print head 12 for periodic print head maintenance.

The above-described functions are selectively engaged by independent motive forces, actuated in a predetermined timing sequence, and in some cases at a particular angular position of transfer drum 16. Each function has a "home position" or a rotationally indexed position that must be initialized or sensed prior to each print, following a paper jam, after filling the media supply tray, or when initiating a print head maintenance process. Some functions, such as transfer roller engagement, web roller engagement, web spool driving, and print head positioning, may each require a reversible motive force. As a result, the above-described functions are typically powered and engaged by multiple independent motive forces, the number of which together with their associated linkages and controllers result in an unduly complex and suboptimal printing mechanism that consumes excessive power and space.

What is needed, therefore, is a compact multiple-function print processor in which the functions are powered by a single motive force; are selectively reversible; are self-homing; are readily, indexed, timed, and sequenced; and coact to form an improved printing mechanism.

SUMMARY OF THE INVENTION

It is an object of this invention to provide an improved multiple-function printing apparatus and method.

It is another object of this invention to provide a multiple-function printing apparatus and method in which the multiple functions are powered by a single motive force.

It is still a further object of this invention to provide a multiple-function printing apparatus and method in which some of the multiple functions are selectively reversible.

It is still another object of this invention to provide a multiple-function printing apparatus and method in which the multiple functions are each self-homing.

It is yet another object of this invention to provide a multiple-function printing apparatus and method in which the multiple functions are readily indexed, timed, and sequenced.

Accordingly, a single process motor provides bidirectional motive force to a printer drive train that selectively engages with multiple self-homing printing functions. A print head is bidirectionally tiltable to a maintenance position and a transfer roller is loadable against a transfer drum by respective missing tooth gear latching mechanisms that are triggered by clapper solenoids. A print media pick roller and transfer drum maintaining devices are actuated by spring-wrap clutches that are actuated by clapper solenoids and which are protected from reverse rotation by a one-way clutch. Print media transport rollers are selectively engaged with the one-way clutch by an electro-mechanical clutch. A picked and transported print medium receives an ink image from a nip formed between the loaded transfer roller and the transfer drum. The printed print medium is stripped from the transfer drum by stripper fingers and directed into media exit rollers for delivery to a media output tray. The stripper fingers and exit rollers are actuated sequentially by cams that are coupled to an eccentric shaft that operates the transfer roller loading function.

These and other objects, features and advantages are obtained by the multi-function printer drive train apparatus and method of the present invention.

BRIEF DESCRIPTION OF THE DRAWINGS

These and other objects, features and advantages of this invention will become apparent upon consideration of the following detailed disclosure of a preferred embodiment of the invention, especially when it is taken in conjunction with the accompanying drawings wherein.

DETAILED DESCRIPTION OF A PREFERRED EMBODIMENT

Figure 1:
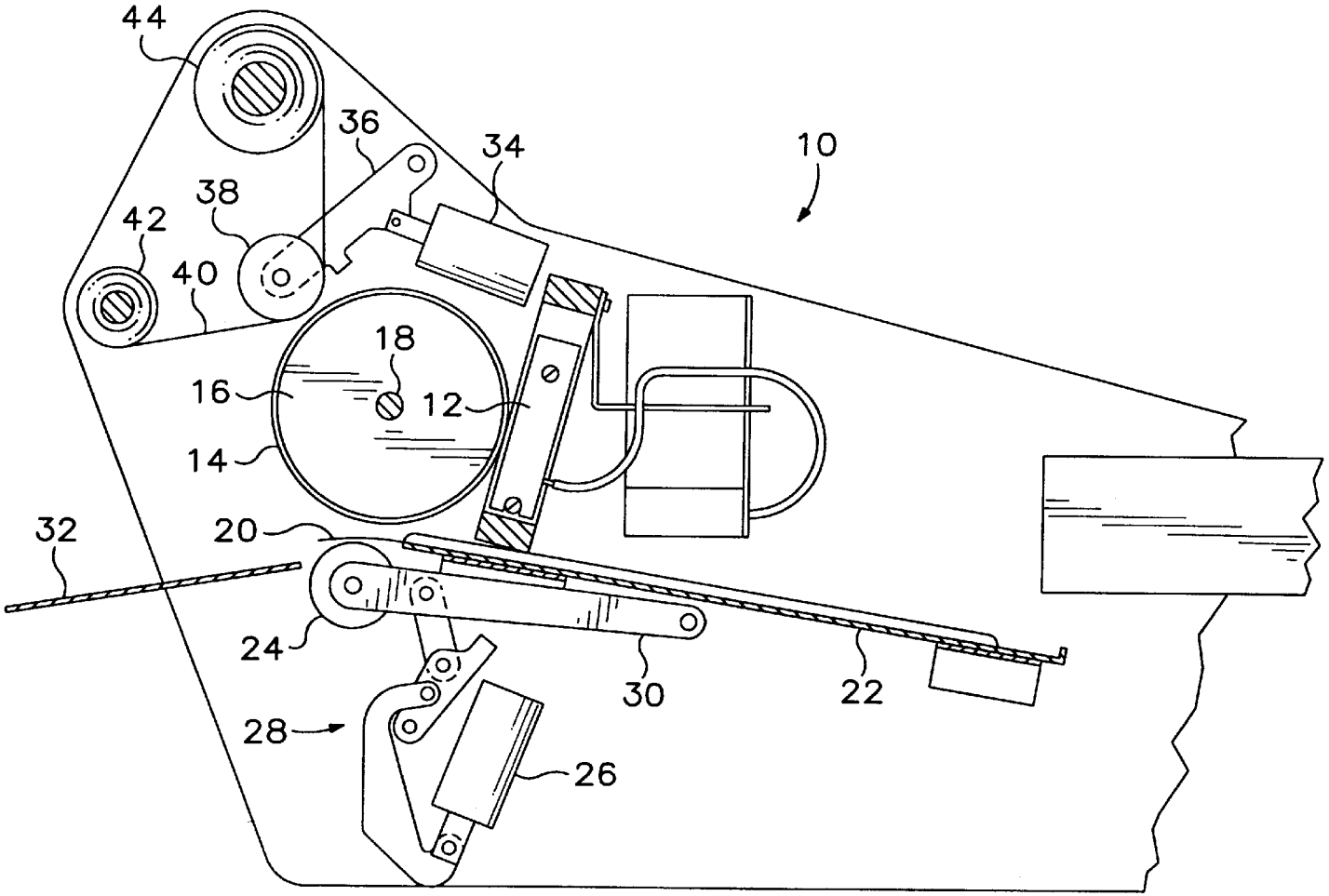
FIG.1 (PRIOR ART)
FIG. 1 is a simplified left side elevational view showing print processing mechanisms of a prior art ink-jet image transfer printer.
Figure 2:
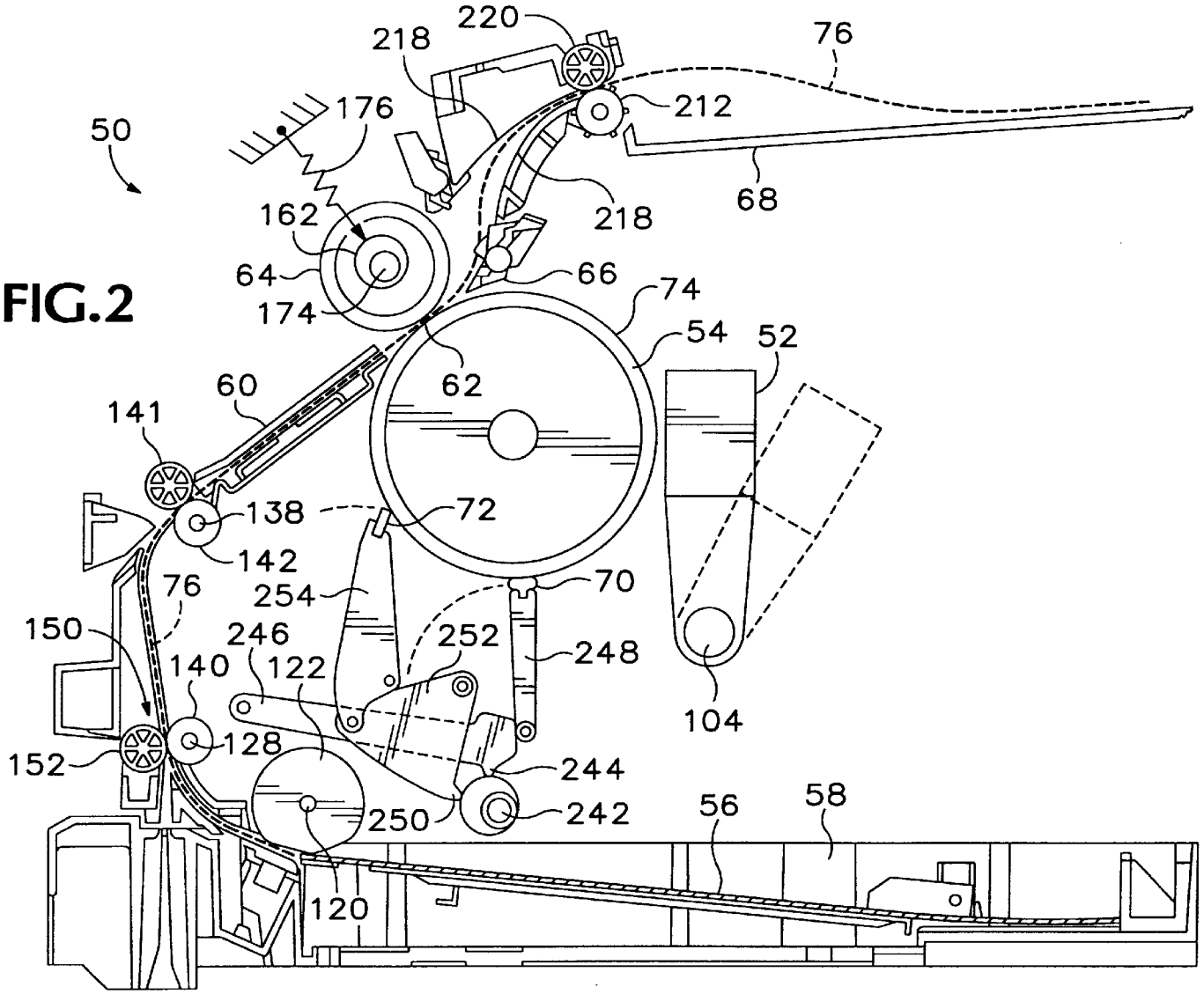
FIG. 2 is a simplified right side elevational view showing print processing mechanisms of an ink-jet image transfer printer employing this invention.

Referring to FIG. 2, print processing functions performed by an ink-jet image transfer printer 50 (hereafter "printer 50") of this invention include: a print head tilt function that provides clearance between a print head 52 and a transfer drum 54 for periodic print head maintenance; a print media picking function that picks a print medium 56 from a media supply tray 58; a print media transport function that transfers the picked print medium 56 from media supply tray 58, through a media preheater 60, and into a transfer printing process; a transfer roller loading function that forms a nip 62 between a transfer roller 64 and transfer drum 54 to engage the transfer printing process; a print media stripping function that engages stripper fingers 66 to strip the printed print medium 56 off transfer drum 54; an exit path function that receives the printed print medium 56 from stripper fingers 66 and directs it through an exit path into a media output tray 68; and a transfer drum maintenance function that sequentially engages with transfer drum 54 a fluid carrying web 70 and a blade 72 that condition transfer a surface 74 of transfer drum 54 for receiving an ink image. Print medium 56 follows a media pathway 76 (shown in dashed lines) through printer 50.

The print head tilt function is described in co-pending U.S. Pat. application Ser. No. 08/300,020 filed Sep. 2, 1994 for PRINTER PRINT HEAD POSITIONING APPARATUS AND METHOD, which is assigned to the assignee of this application and incorporated herein by reference. The print head tilt function and the transfer roller loading function are the only two functions in printer 50 that employ bidirectional rotation of their respective actuating shafts. A one-way clutch, described with reference to FIGS. 3 and 4, mechanically protects the remaining functions from potentially destructive bidirectional rotation.

Figure 3:
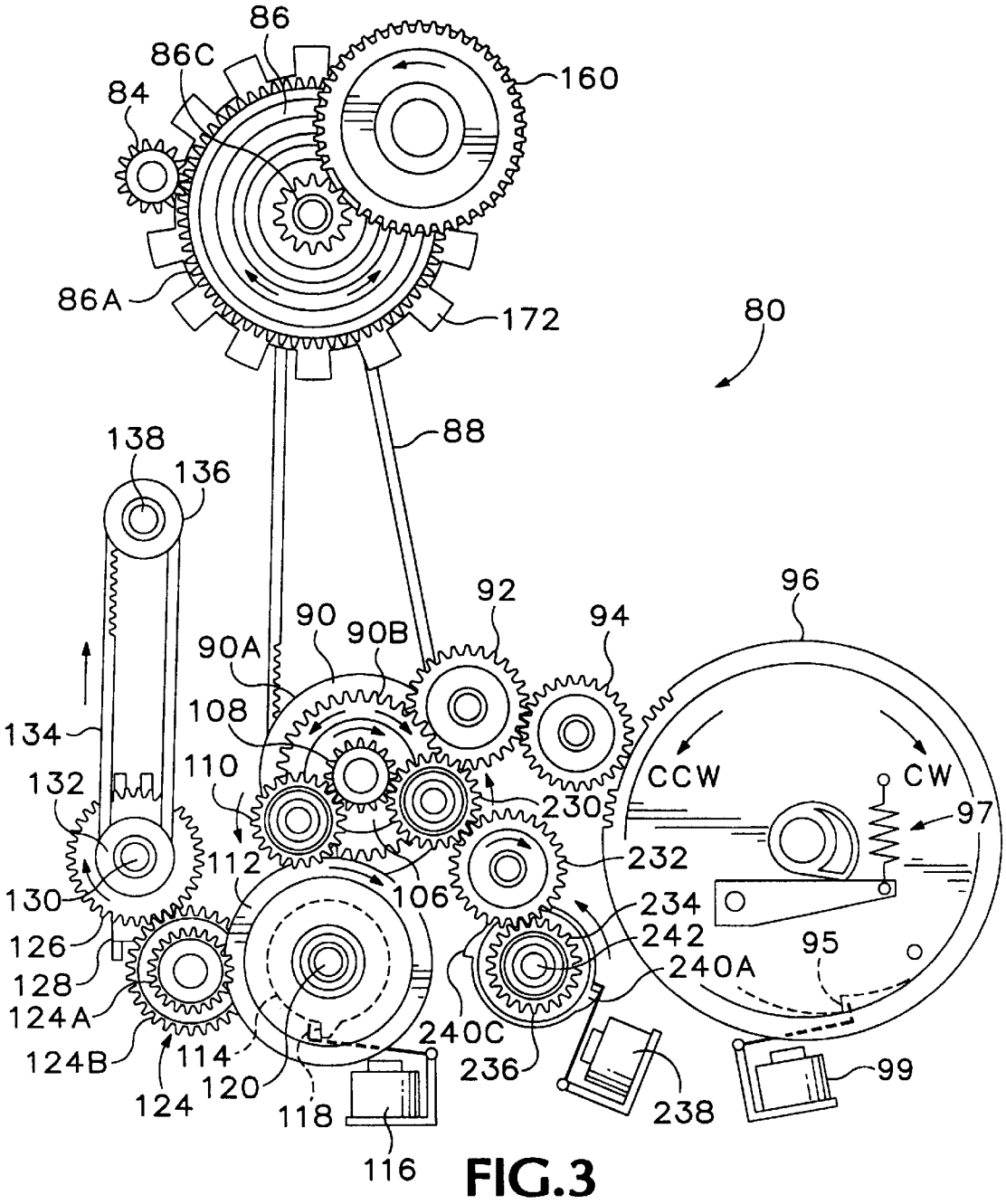
FIG. 3 is a right side view showing the mechanical interrelationships existing among the gears, belts, clutches, and encoders of a drive train that provides motive force for operating the print processing mechanisms of FIG. 2.
Figure 4:
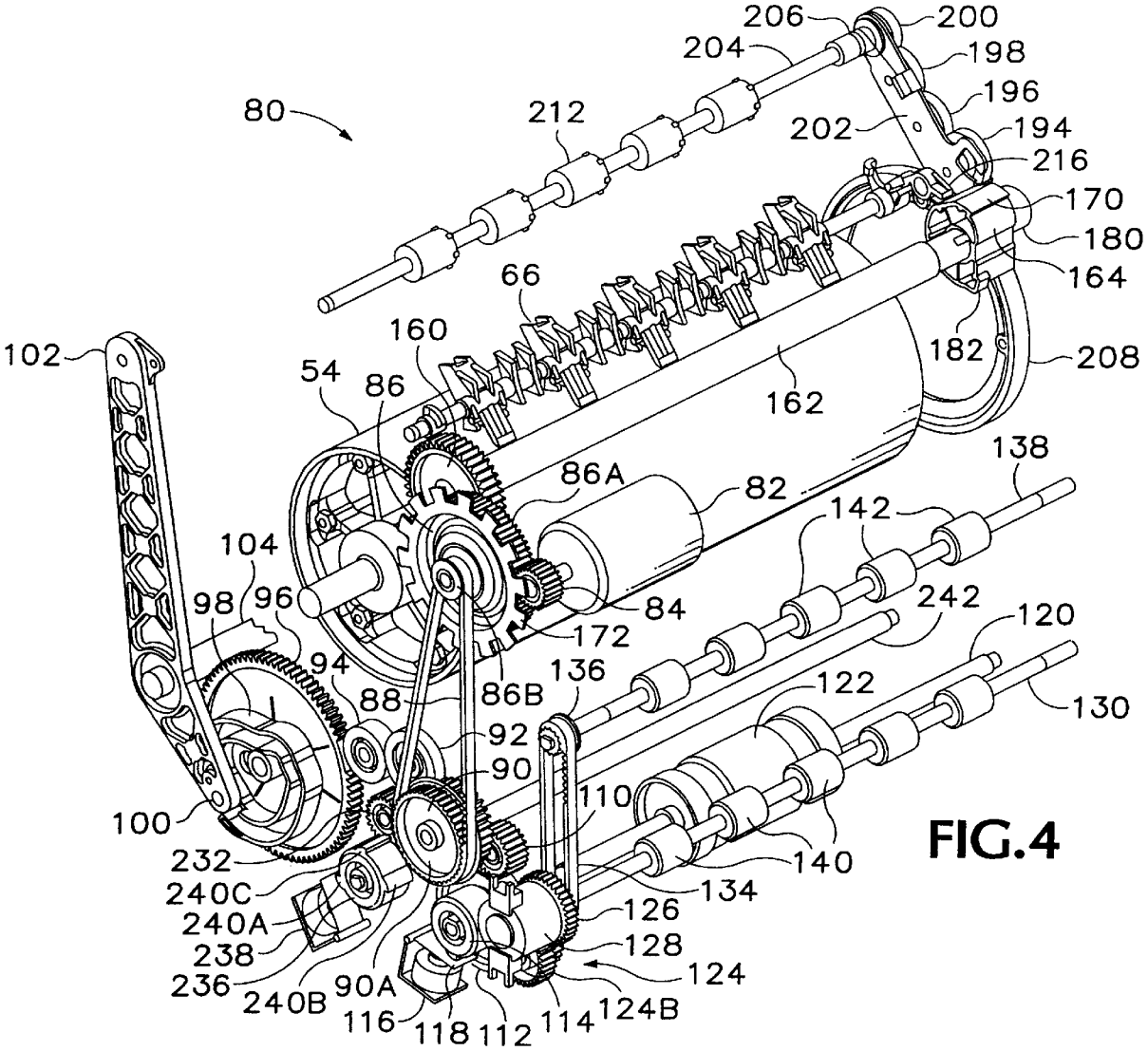
FIG. 4 is a left side isometric view showing the spacial interrelationships existing among a tilt cam, tilt arm, media pick roller, media transfer rollers, eccentric shaft, transfer drum, latch cam, stripper fingers, and exit rollers driven by the drive train of FIG. 3.

FIGS. 3 and 4 show a drive train 80 in which a single process motor 82 provides the motive force to operate the above-described functions.

Regarding the print head tilt function, process motor 82 bidirectionally drives an 18-tooth, 32-pitch drive gear 84 that is meshed with a 72-tooth, 32-pitch gear 86A on a compound gear 86. A 14-tooth, 3-millimeter-pitch pulley 86B on compound gear 86 is coupled by a drive belt 88 to a 42-tooth, 3-millimeter-pitch pulley 90A on a compound gear 90. A 32-tooth, 24-pitch gear 90B on compound gear 90 bidirectionally drives a 24-tooth, 24-pitch idler gear 92, which in turn drives a 20-tooth, 24-pitch idler gear 94. An 80-tooth, 24-pitch missing tooth gear 96 is rotationally biased in a counter-clockwise ("CCW") direction by biasing means indicated generally by the numeral 97, but held in the disengaged ("home") position (shown in FIGS. 3 and 4) by a clapper solenoid 99 abutting a stop 95.

When the clapper solenoid is engaged, missing tooth gear 96 rotates CCW to mesh with idler gear 94, which subsequently controls the rotation of missing tooth gear 96 through the above-described portion of drive train 80. Missing tooth gear 96 allows for CCW and clockwise ("CW") rotation of a scroll cam in which a cam follower 100 rides to pivot a tilt arm 102 about a print head positioning shaft 104.

Referring again to FIG. 2, print head 52 is shown rotated about print head positioning shaft 104 in a printing tilt orientation in solid lines and in a maintenance tilt orientation in dashed lines. Both orientations, and those in-between, are controlled by meshing missing tooth gear 96 with idler gear 94 and causing process motor 82 to rotate by predetermined amounts in the CCW and CW directions. The print head tilt function disengages at the home position when the clapper solenoid is engaged, and the missing tooth portion of missing tooth gear 96 disengages from idler gear 94 and is aligned therewith.

Regarding the print media picking function, FIGS. 3 and 4 show a one-way clutch 106 attached to compound gear 90 such that only CW rotation is transmitted to a 15-tooth, 32-pitch gear 108, which in turn meshes with a 24-tooth, 32-pitch idler gear 110 that meshes with a 54-tooth, 32-pitch gear 112, which is attached to a single-pole spring-wrap clutch 114. A spring-wrap clutch is a well-known device that prevents the transmission of rotational torque from an input gear to an output shaft when a housing surrounding the clutch is constrained from rotating, but which transmits the rotational torque when not constrained. Spring-wrap clutch 114 is constrained in its home position (shown in FIG. 4) by a clapper solenoid 116, that when de-energized, abuts a stop 118. When the clapper solenoid is briefly energized, it disengages from stop 118, allowing spring-wrap clutch 114 to transmit one CW rotation of gear 112 to a shaft 120 before clapper solenoid 116 again abuts stop 118. The single rotation of shaft 120 is transmitted to a pick roller 122 that picks a single sheet of print medium 56 from media supply tray 58 (FIG. 2). Stop 118 on spring-wrap clutch 114 establishes the home position for pick roller 122.

Regarding the print media transport function, gear 112 meshes with a 20-tooth, 32-pitch gear 124A that co-rotates with a 32-tooth, 32-pitch gear 124B, which together form a compound gear 124. Gear 124B meshes with a 36-tooth, 32-pitch transport drive gear 126, rotation of which is selectively transmitted by an electro-mechanical clutch 128 to a lower transport shaft 130. A 14-tooth, 3-millimeter-pitch pulley 132 transmits the rotation of lower transport shaft 130 via a 63-tooth, 3-millimeter-pitch belt 134 to a 14-tooth, 3-millimeter-pitch pulley 136 that drives an upper transport shaft 138. Transport shafts 130 and 138 are, thereby, linked together to co-rotate respective transport rollers 140 and 142 when electro-mechanical clutch 128 is energized.

Referring to FIG. 2, electro-mechanical clutch 128 allows timing the start of the media transport function relative to the media picking function such that picked print medium 56 moves from media supply tray 58 into a rolling nip 150 formed between transport roller 140 and an idler roller 152 for transport into media preheater 60 and nip 62.

Alternatively, the energizing of electro-mechanical clutch 128 may be timed such that picked print medium 56 is fed into a stationary nip 150 to accomplish a print media "deskewing" function. Media deskewing is commonly accomplished by butting the leading edge of a print medium into a stationary nip to buckle the print medium, which is subsequently straightened when the nip begins rolling.

Regarding the transfer printing process, a comprehensive description thereof is found in co-pending U.S. Pat. No. 5,614,933 filed Jun. 8, 1994 for METHOD AND APPARATUS FOR CONTROLLING PHASE-CHANGE INK-JET PRINT QUALITY FACTORS, which is assigned to the assignee of this application and incorporated herein by reference.

Regarding the transfer roller loading function, FIGS. 3 and 4 show that compound gear 86 also includes a 14-tooth, 24-pitch gear 86C that is normally disengaged in the missing tooth portion of a 42-tooth, 24-pitch missing tooth gear 160. Missing tooth gear 160 is attached to one end of an eccentric shaft 162, which has a latch cam 164 attached to the opposite end thereof.

Figure 5:
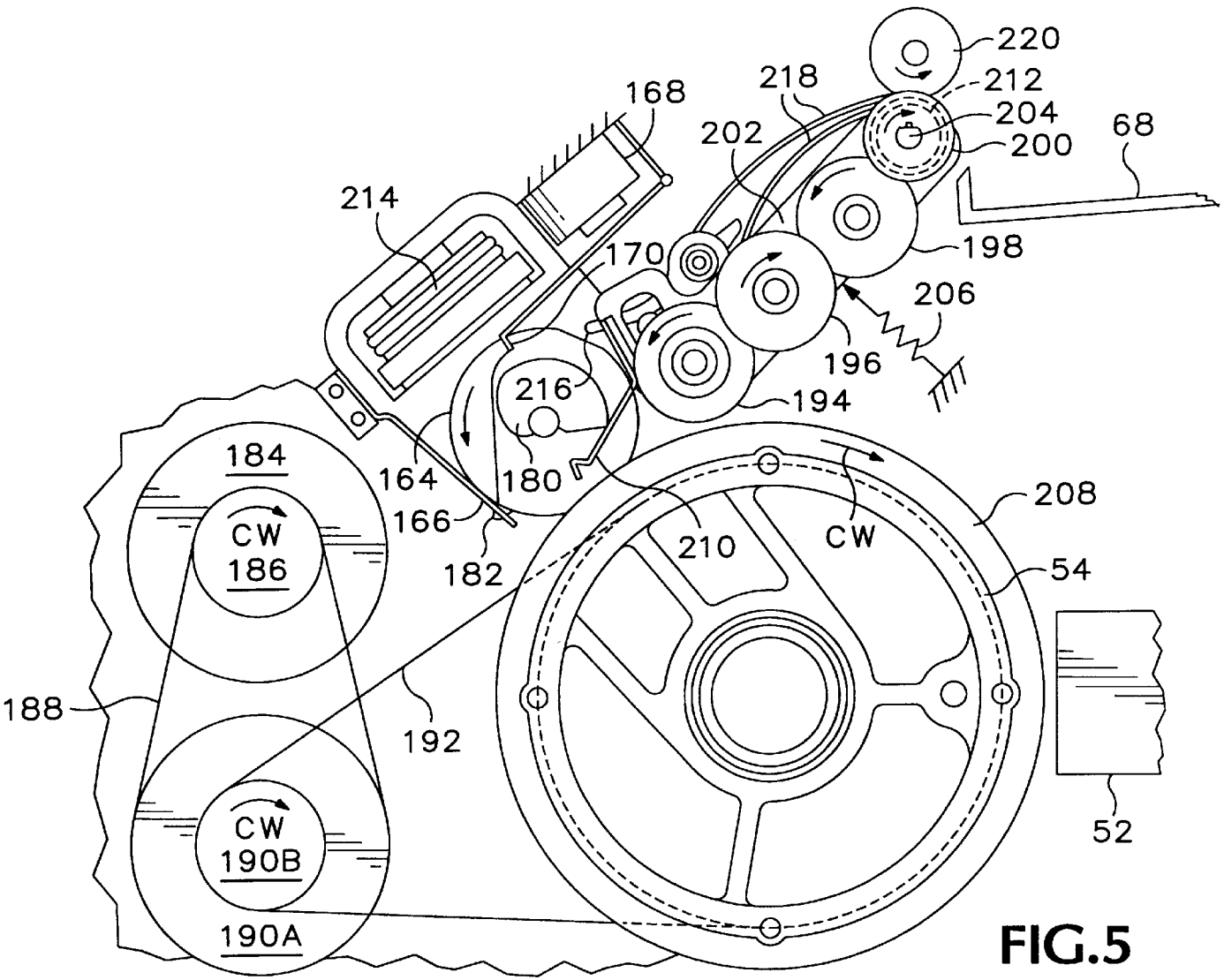
FIG. 5 is a right side view of a latch cam driven media exit path mechanism according to this invention, shown with the latch cam in a home (latched) position in which the exit path mechanism is disengaged from an image transfer drum ring gear.

Referring also to FIG. 5, latch cam 164 is rotationally biased CCW by a leaf spring 166 and is held in a home position by a clapper solenoid 168 that abuts a stop 170 on latch cam 164. When clapper solenoid 168 is energized it disengages from stop 170 allowing missing tooth gear 160 to rotate CCW into engagement with gear 86C. A 14 slot encoder 172 coupled to 14-tooth gear 86C is employed to cause gear 86C to rotate into and stop at any one of 14 rotational positions that ensure proper meshing of gear 86C with missing tooth gear 160 when clapper solenoid 168 is energized.

When the media transport function delivers the leading edge of print medium 56 into nip 62, clapper solenoid 168 is energized to start the transfer roller loading function by meshing missing tooth gear 160 with gear 86C as described above. Process motor 82 is activated and transfers its motive force through gears 84, 86A, 86C, and 160 to rotate eccentric shaft 162 in the CCW direction. Eccentric shaft 162 has a 0.031-inch eccentricity, such that rotating it imparts a simple harmonic displacement to an axial shaft 174 (FIG. 2) about which transfer roller 64 freely rotates. Therefore, when eccentric shaft 162 is in its home (latched or zero-degree) position, a 0.062-inch clearance exists between transfer roller 64 and transfer drum surface 74. When eccentric shaft 162 is rotated to a 180-degree, bottom dead center position, a 600- to 800-pound spring force 176 stored in a load frame is transferred to nip 62. The full spring force is substantially transferred when eccentric shaft 162 is rotated in a range of angles between about 163 degrees and about 191 degrees such that eccentric shaft 162 may be rotated significantly around bottom dead center without significantly changing the force in nip 62.

Continued CCW rotation of eccentric shaft 162 removes spring force 176 from transfer roller 64, restores clearance in nip 62, returns eccentric shaft 162 to its home (latched) position, and completes the roller loading function.

Figure 6:
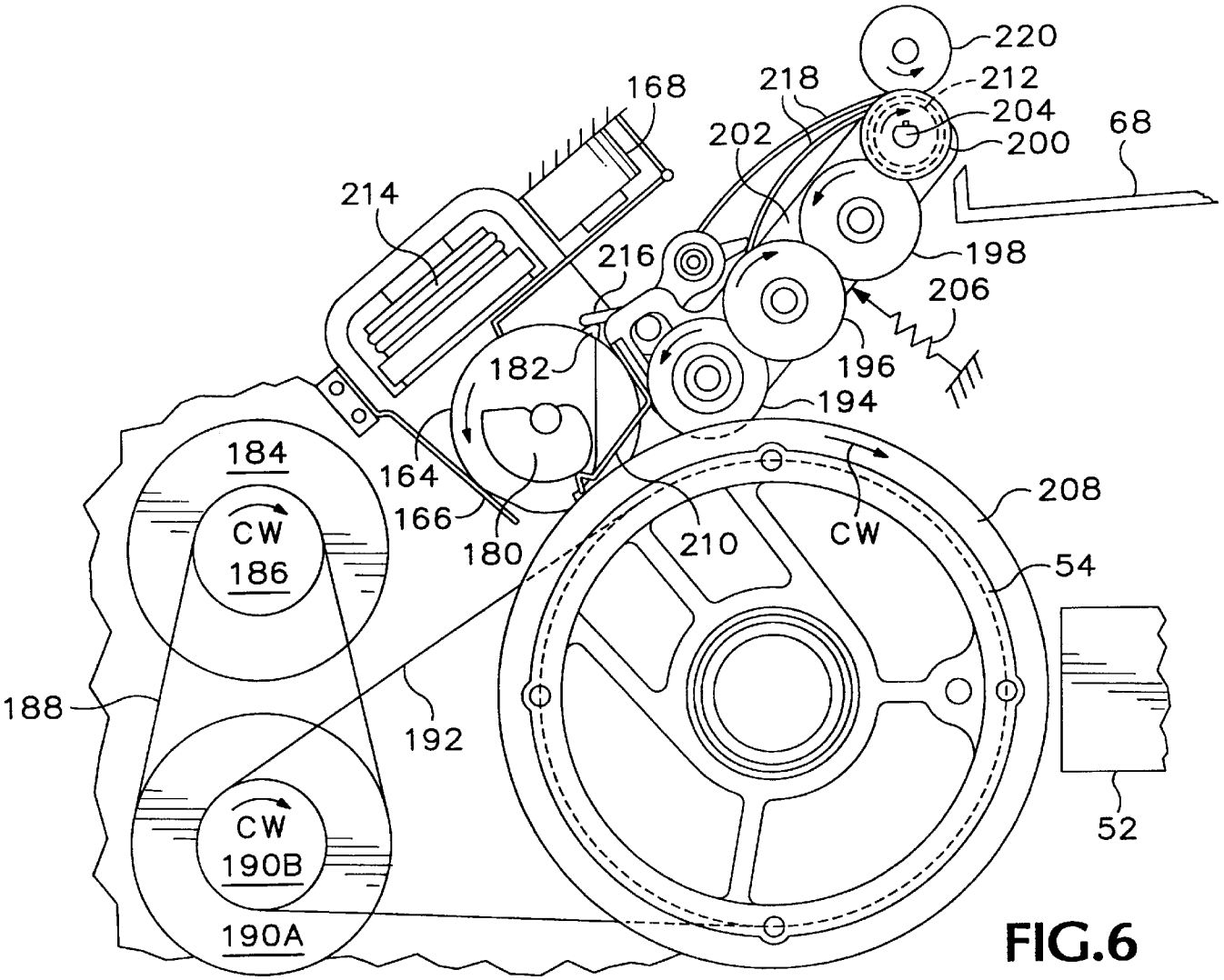
FIG. 6 is a right side view of the latch cam driven media exit path mechanism of FIG. 5, shown with the latch cam in a 180 degree rotated position in which the exit path mechanism is engaged with the image transfer drum ring gear.

Regarding the print media stripping and exit path functions, FIGS. 4–6 shows latch cam 164 further including an exit gear engagement cam 180 and a stripper finger actuating lobe 182 that are positioned on axially opposite sides of latch cam 164. The print media stripping and exit path functions are actuated in cooperation with the above-described roller loading function to perform the transfer printing process as follows.

A servo-controlled drum drive motor 184 CW rotates a pulley 186 that is coupled by a belt 188 to a compound idler pulley 190A which co-rotates with a compound idler pulley 190B. A belt 192 CW rotates transfer drum 54. Transfer drum 54 is rotated at a precisely controlled rate while receiving a high-resolution ink image from print head 52 to ensure that the ink image is properly registered. This requires that all undesirable mechanical loads, such as transfer roller 64, stripper fingers 66, and others are disengaged from transfer drum 54 while it receives the ink image.

Referring to FIG. 5, the above-described roller loading function is started by energizing clapper solenoid 168 after transfer drum 54 receives the ink image. Latch cam 164 is shown at the home, zero-degree position.

An exit gear train including gears 194, 196, 198, and 200 is mounted to an arm 202 that pivots on a shaft 204 to which gear 200 is attached. Arm 202 is biased away from transfer drum 54 by a spring 206 such that gear 194 is normally disengaged from a 100-tooth, 24-pitch ring gear 208 surrounding the periphery of one end of transfer drum 54. Referring also to FIG. 6, as latch cam 164 rotates CCW about 45 degrees, an exit path engagement spring 210 riding on exit gear engagement cam 180 causes arm 202 to pivot gear 194 into engagement with ring gear 208. Gear 194 is a 17-tooth, 24-pitch gear that together with gears 196, 198, and 200 cause shaft 204 to rotate a media exit roller 212 at a tangential rotational speed that is synchronized with the surface speed of transfer drum 54.

As latch cam 164 rotates through about 82 to about 109 degrees, eccentric shaft 162 (FIG. 2) causes transfer roller 64 to begin contacting transfer drum 54. The full force 176 (FIG. 2) of a pair of springs 214 (one shown) equal to about 600 pounds (300 per spring) is transferred through transfer roller into nip 62 as latch cam 164 rotates through about 163 to about 191 degrees. The image transfer process starts at about 163 degrees at which time the leading edge of print medium 56 is drawn by the rotation of transfer drum 54 through nip 62 into the vicinity of stripper fingers 66. Remember that transfer roller 64 freely rotates on eccentric shaft 162.

As latch cam 164 rotates through about 165 degrees to about 177 degrees (the position shown in FIG. 6), stripper finger actuating lobe 182 trips a lever 216 that causes stripper fingers 66 to contact transfer drum 54, thereby stripping the leading edge of print medium 56 off transfer drum 54 and direct it between a pair of exit guides 218. Stripper fingers 66 are raised as latch cam 164 rotates through about 183 to about 188 degrees.

Transfer drum 54 continues delivering print medium 56 between exit guides 218 until the leading edge of print medium 56 enters a nip formed between media exit roller 212 and an idler roller 220 and is directed into media output tray 68.

The image transfer process is completed by the time latch cam 164 rotates past about 191 degrees, and transfer roller 64 disengages from transfer drum 54 at about 251 degrees to about 278 degrees. By this time print medium 56 has been completely delivered to media output tray 68.

When latch cam 164 rotates through about 300 degrees, the profile of exit gear engagement cam 180 drops, causing arm 202 to pivot away from transfer drum 54, thereby disengaging gear 194 from ring gear 208.

When latch cam 164 rotates to about 360 degrees, missing tooth gear 160 (FIG. 3) disengages from compound gear 86C, clapper solenoid 168 abuts stop 170, and the transfer printing process is completed. Transfer roller 64, stripper fingers 66, and exit path arm 202 are in their respective home positions.

Regarding the transfer drum maintenance function, FIGS. 3 and 4 show a 24-tooth, 32-pitch idler gear 230 and a 30-tooth, 32-pitch idler gear 232 receiving rotational force from gear 108. Idler gear 232 meshes with a 20-tooth, 32-pitch gear 234 on a three-pole spring-wrap clutch 236. Spring-wrap clutch 236 is constrained in its home position by a clapper solenoid 238, which, when de-energized, abuts one of three stops 240A, 240B, and 240C such that each time clapper solenoid 238 is briefly energized, it disengages from one stop and advances to the next stop, thereby allowing spring-wrap clutch 236 to incrementally transmit rotation of gear 234 to a drum maintenance cam shaft 242. Stop 240A on spring-wrap clutch 236 establishes the home position for drum maintenance cam shaft 242. Because there are three stops, a homing sensor (not shown) detects which one is stop 240A for homing purposes.

Referring also to FIG. 2, stops 240A, 240B, and 240C cause drum maintenance cam shaft 242 (FIG. 2) to rotate sequentially to and stop at respective home, web-actuating, and blade-actuating positions. In the web-actuating position established by stop 240B, a cam follower 244 on a lever arm 246 causes a lever arm 248 to swing fluid carrying web 70 into contact with transfer drum 54.

In the blade-actuating position established by stop 240C, a cam follower 250 on a lever arm 252 causes a lever arm 254 to swing blade 72 into contact with transfer drum 54.

Web 70 and blade 72 sequentially contact transfer drum 54 such that web 70 contacts first followed by blade 72. Web 70 then retracts followed by blade 72. Drum maintenance cam shaft 242 then returns to the home position, thereby completing the transfer drum maintenance function that prepares surface 74 of transfer drum 54 for receiving an ink image.

Referring to FIGS. 2 and 3, drive train 80 solves potentially serious problems encountered when printer 50 looses power, print medium 56 becomes jammed somewhere along media pathway 76, or printer 50 otherwise malfunctions. When any of the above problems occur, the functions of printer 50 must gracefully return to their home positions without damaging any related mechanisms.

To review, the print head tilt and transfer roller loading functions are self-homing by virtue of respective missing tooth gears 96 and 160. The exit path and print media stripping functions are slaved to the self-homing action of the transfer roller loading function. The print media picking and transfer drum maintenance functions are self-homing by virtue of respective spring-wrap clutches 114 and 236, the latter also having a homing sensor. Spring-wrap clutches 114 and 236 are protected from reverse rotation by a one-way clutch 106. The print media transport function has no inherent home position.

It should be noted that because the eccentric shaft 162 can rotate through about 28 degrees without causing substantial force variations on the transfer roller 64 the compact latch cam 164 design can be used to actuate the stripper fingers 66 and the media exit rollers 212. The total angular displacement of the eccentric shaft 162 and, therefore, also the latch cam 164 during the transfer process is from about 163 degrees to about 191 degrees, while the exit gear train with the media exit rollers 212 is engaged from about 45 degrees to about 300 degrees. The total force applied to the transfer roller 64 is substantially uniform and varies only by about 20 pounds from about 580 pounds to about 600 pounds back to about 580 pounds as the eccentric shaft 162 rotates from about 163 degrees to about 191 degrees. 15 degrees of rotation of the eccentric shaft 162 moves the contact surface of the shaft about 1 mil and changes the force applied to the transfer roller 64 by about 10 or more pounds. At about 163 degrees rotation the stripper fingers 66 are waiting to engage the surface of the transfer drum 54, at about 180 degrees rotation the stripper fingers 66 contact the surface of the drum 54, and at about 191 degrees the stripper fingers 66 are disengaged.

Skilled workers will recognize that portions of this invention may have alternative embodiments. For example, many of the functions are applicable to printers other than ink-jet and ink-jet transfer printers and may, therefore, be selectively employed in various combinations. The functions may each be implemented in a variety of different ways. For example, drive train gear and belt ratios other than those described may be employed to satisfy particular applications. The media transport function may be implemented with or without a media deskewing function. The transfer roller loading function preferably employs stop-and-drop media timing in which the leading edge of the print medium enters the nip and stops before the transfer roller is loaded, but may accommodate load-on-the-fly media timing in which the leading edge of the print medium enters the nip after the transfer roller is loaded. Of course, particular drive train applications may employ entirely different functions that, never-the-less, employ the principles of this invention.

While the invention has been described above with references to specific embodiments thereof, it is apparent that many changes, modifications, and variations in the materials, arrangement of parts and steps can be made without departing from the inventive concept disclosed herein. For example, it will be appreciated that this invention is also applicable to multi-function drive train applications other than those found in ink-jet printers. Accordingly, the spirit and broad scope of the appended claims is intended to embrace all such changes, modifications and variations that may occur to one of skill in the art upon a reading of the disclosure.

Having thus described the invention, what is claimed is:

1. A printer having a multi-function drive train, comprising:

a motive force bidircetionally rotating the drive train;

a shaft selectively engaged with the drive train to receive rotation therefrom that couples the motive force to a roller loading function as the shaft rotates from a home rotational position through a first range of angular positions that cause a first roller to move into contact with a drum to form a nip therebetween;

the shaft further rotating through a second range of angular positions that cause a stripper finger to engage the drum and strip a print medium therefrom; and the shaft further rotating through a third range of angular positions that cause a second media exit roller to activate to transport the print medium from the stripper finger to a media output tray.

2. The appparatus of claim 1 in which the first range of angular positions is from about 82 degrees to about 278 degrees displaced from the home angular position.

3. The apparatus of claim 1 in which the second range of angular positions is from about 163 degrees to about 191 degrees displaced from the home angular position.

4. The apparatus of claim 1 in which the third range of angular positions is from about 45 to about 300 degrees displaced from the home angular position.

5. The apparatus of claim 1 in which the shaft is held in the home rotational position by a solenoid abutting a stop on a latch cam, and in which actuating the solenoid releases the stop thereby freeing the shaft to rotate through the first, second, and third ranges of angular positions before returning to and stopping at the home rotational position.

6. The apparatus of claim 5 in which the shaft is an eccentric shaft that moves the first roller into contact with the drum as the shaft rotates through the first range of angular positions.

7. The apparatus of claim 5 in which the shaft is coupled to a stripper finger engagement lobe that moves the stripper finger into contact with the drum as the shaft rotates through the second range of angular positions.

8. The apparatus of claim 5 in which the shaft is coupled to an exit roller engagement cam that engages the exit roller with a gear train having a ratio that causes a tangential surface speed of the exit roller to match a tangential surface speed of the drum as the shaft rotates through the third range of angular positions.

9. The apparatus of claim 7 in which while the shaft rotates through the second range of angular positions it disengages the stripper finger from contact with the drum.

10. A printer having multi-function drive train driven by a single motor, the drive train comprising:

a motive force provided by the single motor bidirectionally rotating a drive train;

a first shaft having a home rotational position and being selectively engaged with the drive train to receive bidirectional rotation therefrom that couples the motive force to a first plurality of printer functions that are actuated as the shaft rotates through a range of angular positions; and gear means being engaged with the drive train to receive rotation therefrom that couples the motive force to a plurality of additional printer functions including a print media picking function, a print media transport function a print head tilt function a deskewing function and a drum maintenance function.

11. The apparatus of claim 10 in which the printer is an ink-jet image transfer printer.

12. The apparatus of claim 10 in which the first shaft is selectively engaged with the drive train through at least one of a missing tooth gear and an electro-mechanical clutch.

13. The apparatus of claim 10 in which a missing tooth gear is rotationally biased in a first rotational direction when constrained at the home rotational position by a solenoid abutting a stop, and in which the missing tooth gear is selectively engaged with the drive train by energizing the solenoid to release the stop.

14. The apparatus of claim 10 in which the gear means is selectively engaged with the drive train through at least one of a spring-wrap clutch and a one-way clutch.

15. The apparatus of claim 10 in which a spring-wrap clutch is constrained at a home rotational position by a solenoid abutting a stop, and in which the gear means is selectively engaged with the drive train by energizing the solenoid to release the stop.

16. The apparatus of claim 10 in which one of the second plurality of additional printer functions is a print head tilt function that provides a clearance between a print head and a drum, the clearance providing access to the print head for periodic maintenance thereof.

17. The apparatus of claim 15 in which one of the plurality of additional printer functions is a print media picking function and the gear means rotates a pick roller from a home rotational position to deliver a single print medium from a media supply tray to a print media transport roller.

18. The apparatus of claim 10 in which one of the plurality of additional printer functions is a drum maintenance function and the gear means rotates a second shaft from a home rotational position to actuate a drum conditioning means.

19. The apparatus of claim 18 in which the drum conditioning means is at least one of a web and a blade, and the second shaft is selectively engaged with the drive train through a multi-pole spring-wrap clutch such that the second shaft rotates from the home rotational position to at least one other rotational position that actuates the drum conditioning means into contact with the drum.

20. The apparatus of claim 10 in which one of the plurality of additional printer functions is a print media transport function and the gear means rotates a print media transfer roller that receives a print medium from a media supply tray and transports the print medium into an indicia receiving process.

21. The apparatus of claim 20 in which the print media transfer roller contacts an idler roller to form a nip therebetween, and the selective engagement of a third shaft with the drive train is delayed until after the print medium is received in the nip such that the print medium undergoes a deskewing function.

22. The apparatus of claim 10 in which the first plurality of printer functions includes a roller loading function and the first shaft rotates through a first range of angular positions and moves a roller into contact with a drum to form a nip therebetween.

23. The apparatus of claim 10 in which the first plurality of printer functions further includes an exit path function and the first shaft rotates from a home rotational position through a second range of angular positions to actuate a media exit roller that receives a printed print medium from a print processor and delivers the printed print medium to a media output tray.

24. The apparatus of claim 23 in which the first shaft further rotates through a third range of angular positions and actuates a print media stripper finger that strips the printed print medium from a drum in the print processor and directs the printed print medium toward the media exit roller.

* * * * *